United States Patent [19]

Arnold

[11] 3,934,738

[45] Jan. 27, 1976

[54] TOOL CONNECTING

[75] Inventor: Carroll H. Arnold, Westminster, Mass.

[73] Assignee: Wain-Roy, Inc., Hubbardston, Mass.

[22] Filed: Apr. 1, 1974

[21] Appl. No.: 456,523

[52] U.S. Cl. ..... 214/145 A

[51] Int. Cl.[2] ..... E02F 3/70

[58] Field of Search ..... 214/145, 131 A, 620, 768, 214/145 A; 172/272

[56] References Cited

UNITED STATES PATENTS

| | | | |
|---|---|---|---|
| 2,447,150 | 8/1948 | Anderson | 214/145 |
| 3,389,819 | 6/1968 | Schumacher | 214/145 X |
| 3,512,665 | 5/1970 | Westendorf | 214/145 |
| 3,556,323 | 1/1971 | Heimmermann | 214/145 |
| 3,794,195 | 2/1974 | Clevenger et al. | 214/620 X |

*Primary Examiner*—M. Henson Wood, Jr.
*Assistant Examiner*—Michael J. Forman

[57] ABSTRACT

Apparatus for releasably securing a materials handler to a boom while permitting rotation of the materials handler about a first axis fixed with respect to the boom, and comprising a hitch adapted for pivotal connection to the boom for rotation about the first axis and including spaced apart hook and lock members, and cooperating structure on the materials handler for receiving and engaging the hook member and for engaging the lock member; the hook member extending downwardly from the body of the hitch with the nose of the hook facing the first axis and having a predetermined maximum width, a tapering nose portion of lesser width, a jaw having an engagement surface, a rear surface, and an overall depth defined by the rear surface and the front of the nose; the cooperating structure including a top wall for engaging the bottom of the hitch body, an opening in the wall of width substantially equal to the maximum width of the hook member for receiving the hook member, a rigid cross member extending transversely the width of the opening adjacent the forward edge thereof, and a locking member spaced from the opening on the side thereof opposite the cross member for engaging the hitch locking member, the distance between the hitch locking member and a point on the hook engagement surface being substantially equal to the distance between the materials handler locking member and the point of the cross member engaging the point on the hook engagement surface.

36 Claims, 10 Drawing Figures

FIG 7
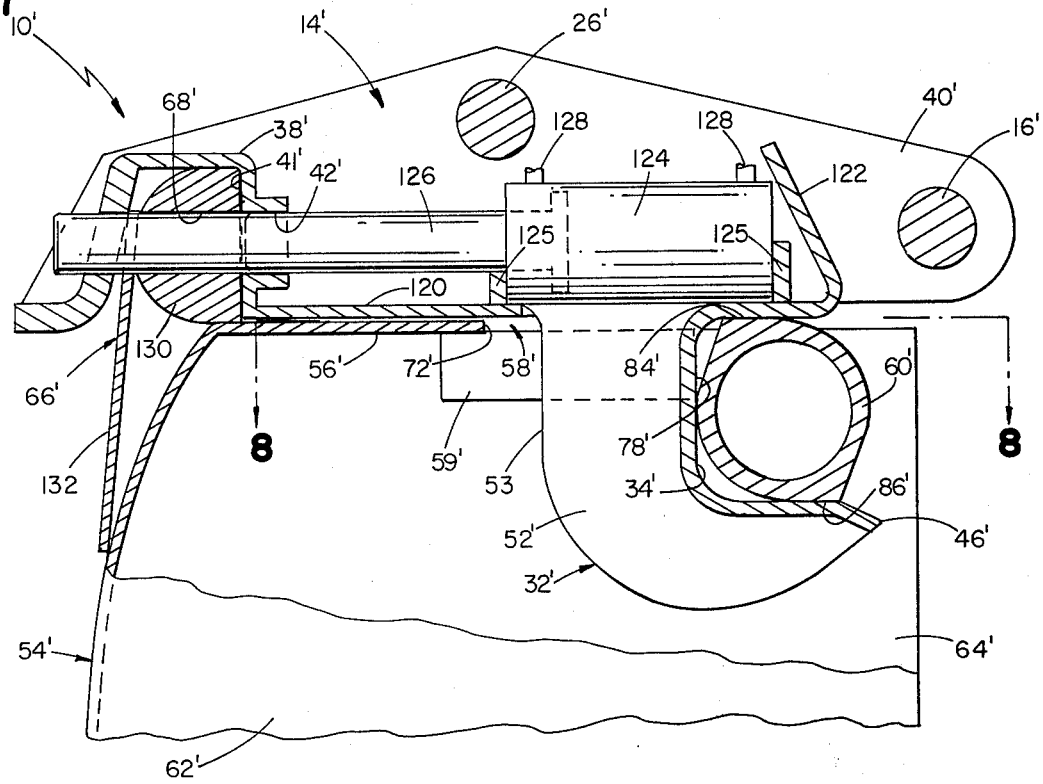
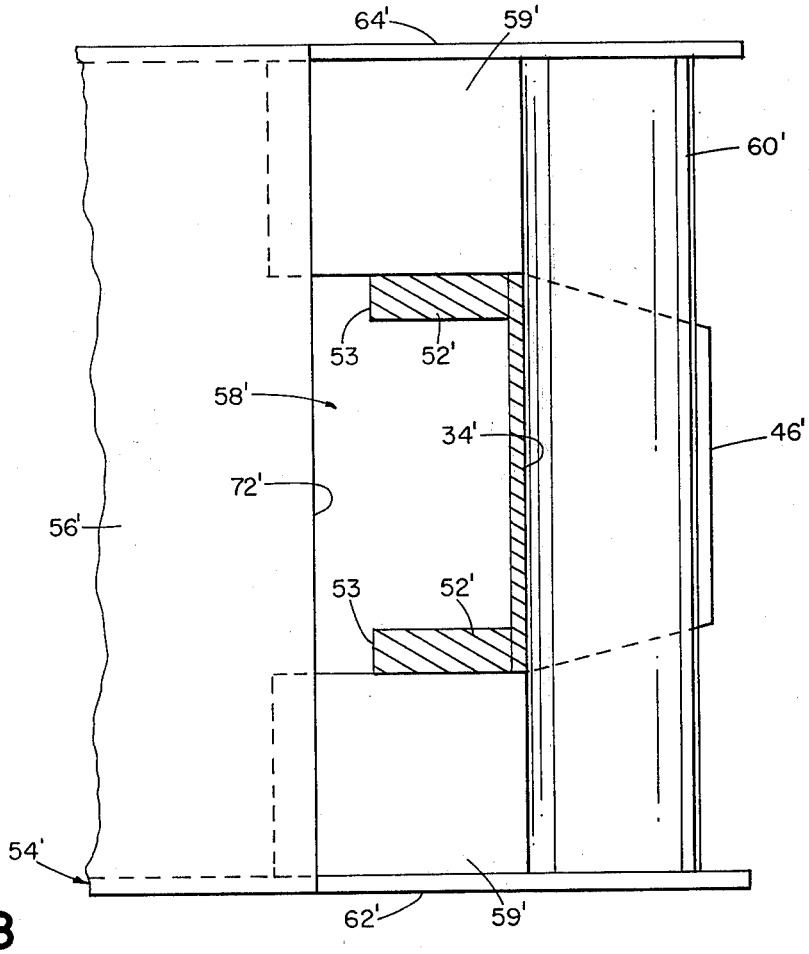
FIG 8

TOOL CONNECTING

BACKGROUND OF THE INVENTION

This invention relates to materials handling and, more particularly, to mounting materials handling tools (e.g., buckets, blades, rippers, augers and the like) on, for example, dippersticks of backhoes.

The changing of materials handling tools mounted on a backhoe dipperstick traditionally has been a laborious and timeconsuming job. In recent years there have appeared suggestions for simplifying this task by connecting different tools to, rather than replacing, the bucket; and by providing connecting mechanisms on the tool and dipperstick which reduce the time and effort required for tool change-over. Such schemes have suffered from various drawbacks, however. Principal among these are the need for precise vertical alignment of the tool and dipperstick, the inability of the backhoe operator either to change tools himself or to make the change without either leaving his seat, the necessity of manually locking each tool to the dipperstick or bucket, the danger presented by improperly or incompletely connected tools, and the requirement that a different set of tools be provided for each size or type of backhoe.

SUMMARY OF INVENTION

In view of the foregoing, it is a principal object of the present invention to provide a system for releasably engaging any of a wide range of materials handling tools to any type of backhoe. Other objects include overcoming the above-mentioned problems by providing such a system in which, inter alia, a single operator can change tools, often without leaving his seat; the danger of falling tools is eliminated; and the same tools may be used with either a fixed or a swinging connector.

The invention features apparatus for releasably securing a materials handler to a boom while permitting rotation of the materials handler about a first axis fixed with respect to the boom, and comprising a hitch adapted for pivotal connection to the boom for rotation about the first axis and including spaced apart hook and lock members, and cooperating structure on the materials handler for receiving and engaging the hook member and for engaging the lock member; the hook member extending downwardly from the body of the hitch with the nose of the hook facing the first axis and having a predetermined maximum width, a tapering nose portion of lesser width, a jaw having an engagement surface, a rear surface, an overall depth defined by the rear surface and the front of the nose; the cooperating structure including a top wall for engaging the bottom of the hitch body, an opening in the wall of width substantially equal to the maximum width of the hook member for receiving the hook member, a rigid cross member extending transversely the width of the opening adjacent the forward edge thereof, and a locking member spaced from the opening on the side thereof opposite the cross member for engaging the hitch locking member, the distance between the hitch locking member and a point on the hook engagement surface being substantially equal to the distance between the materials handler locking member and the point of the cross member engaging said point on said hook engagement surface. In preferred embodiments in which the hook jaw has parallel upper and lower engagement surfaces and the cross member is substantially cylindrical, tangential to the top wall, and has a diameter substantially equal to the distance between the upper and lower engagement surfaces, there are featured tangentially projecting flat engagement surfaces on the cross member, a hook maximum depth greater than the distance from the rear edge of the materials handler opening to the nearest point of the cross member and not less than the sum of that distance and one-half the diameter of the cross member, an upper portion of the hook defining parallel surfaces spaced apart the hook maximum width and arranged for engaging the sides of the materials handler opening, locking members including camming surfaces for urging the rear engagement surface of the hook against the cross member and relatively aligning the locking members, a floating hydraulic cylinder actuating a locking pin extending through the locking members along an axis parallel to the top wall and perpendicular to the first axis, and means for pivoting the hitch hook and body relative to each other about an axis generally perpendicular to said first axis.

BRIEF DESCRIPTION OF THE DRAWINGS

Other objects, features, and advantages of the invention will appear from the following description of preferred embodiments thereof, taken together with the accompanying drawings in which:

FIG. 7 is a side view, partially in section, of a modified embodiment of the present invention;

FIG. 8 is a sectional view, taken at 8—8 of FIG. 7; and,

Referring now to FIGS. 1–6 the drawings, a hitch, generally designated 10 and including a main body 14 and a downwardly depending hook 32, is pivotally connected to the dipperstick 12 of a backhoe for rotation about an axis 16 perpendicular to the longitudinal axis of the dipperstick. As shown, the connection between the hitch and dipperstick is conventional. Axis 16 is defined by the bucket hinge pin, which connects one end of the main body 14 of hitch 10 to the end of the dipperstick. The bucket and guide links 22, 24 are connected to each other by hinge pin 28 and, respectively, to body 14 and dipperstick 12, at points spaced from axis 16, by hinge pins 26, 30. The piston 20 of bucket cylinder 18 is connected to link hinge pin 28, and the cylinder 18 is connected to the dipperstick at a point (not shown) spaced further from axis 16.

Figure 3:
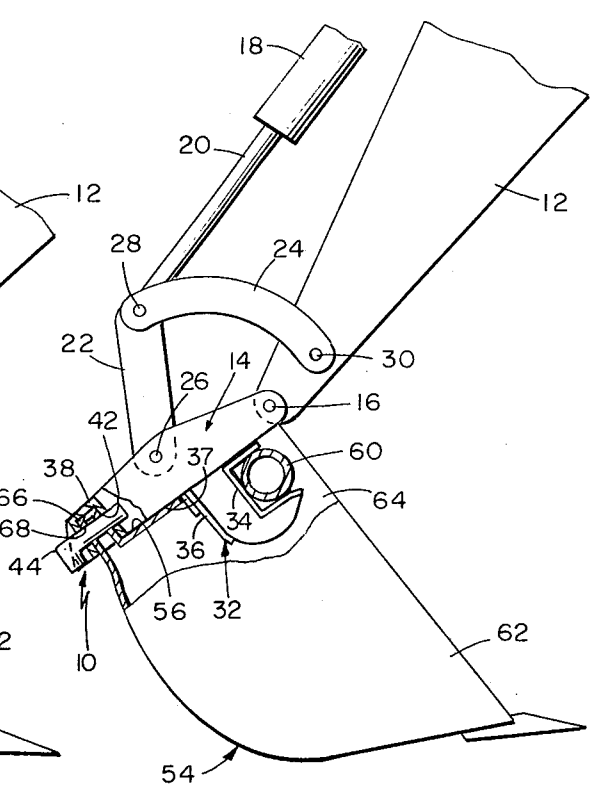
FIGS. 1–3 are partially broken away side elevations of a backhoe dipperstick and a materials handling tool which embody features of the present invention; the figures being slightly simplified and illustrating three stages in the attachment of the tool to the dipperstick.

As shown, hook 32 projects downwardly from hitch body 14, intermediate axis 16 and hinge pin 26, with its nose portion 46 facing toward axis 16. It comprises a pair of generally parallel, spaced apart side plates 52, a generally U-shaped channel 34 extending between and welded to a recess in the forward edges of side plates 52 and defining the jaw of the hook, and a rear plate 36 extending between and welded to the rear edges of side plates 52.

Figure 4:
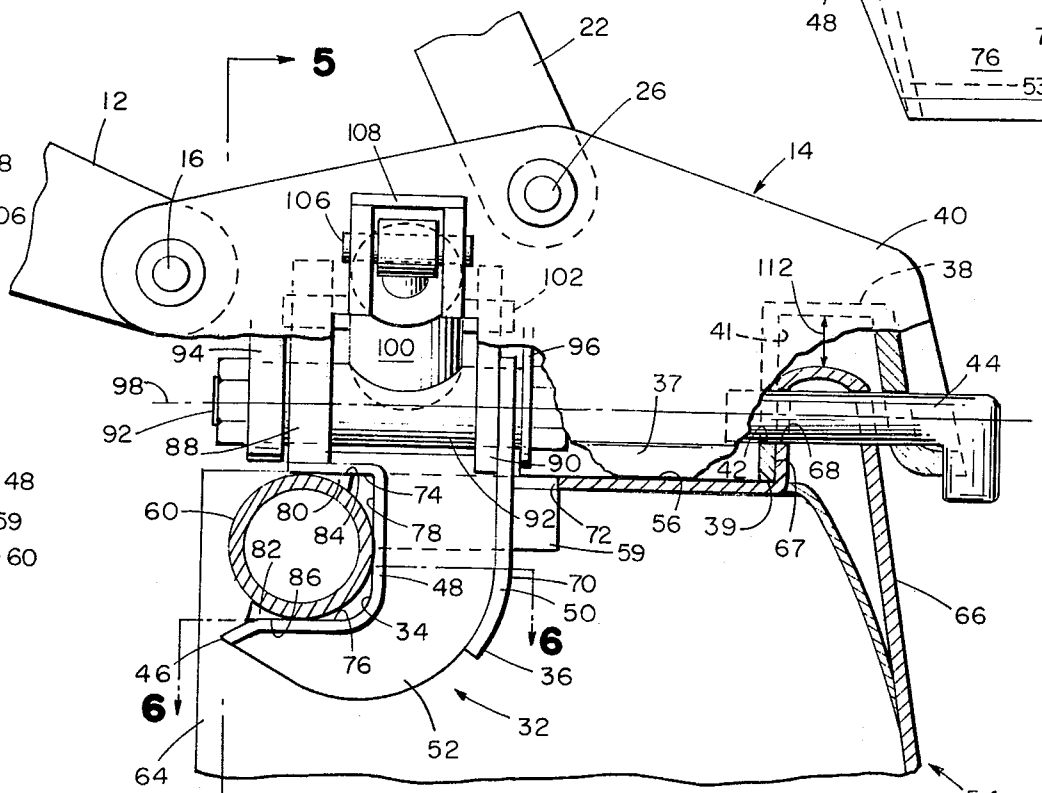
FIG. 4 is a partially broken away side elevation of portions of the dipperstick and materials handling tool of FIGS. 1–3, illustrating certain additional features thereof in greater detail.

Hitch body 14 comprises a pair of spaced side plates 40, each having a lower edge 37 and to which hinge pins 16, 26 are connected and a receptacle 38 recessed between plates 40 adjacent the end of hitch body 14 opposite axis 16. In cross-section, receptacle 38 defines a trapezoid, open at its bottom. The bottom edge 39 of the receptacle front wall is not flat, but rather defines a downwardly pointing, rounded tongue, as shown in FIG. 4. A pair of aperatures 42, axially aligned with each other along an axis perpendicular to axis 16, extend through the front and rear walls of receptacle 38.

Hitch 10 is shown attached to a bucket 54, which is of generally conventional construction except for the portion thereof which is specially designed to cooperate with and engage the hitch. As should be evident, similar cooperating structure may be provided on any materials handling tool, thereby permitting the desired releasable engagement between hitch 10 and the particular desired tool.

The cooperating structure for permitting such engagement with bucket 54 includes an opening 58 in the top wall 56 of the bucket, pair of bearing plates 59 welded on the inside surfaces of bucket side walls 62, 64 and defining the width of opening 58 (a width substantially the same as the maximum width of hook 32); a cylindrical cross member 60 spanning the width of opening and positioned at the forward end of opening 58 with its top tangent to the top of top wall 56; and a laterally centered ear 66 spaced to the rear of opening 58 and projecting upwardly from the rear edge of bucket top wall 56. As shown, ear 66 is generally trapezoidal in longitudinal cross-section. Its front surface 67 is arranged to engage the inner surface 41 of the front wall hitch of receptacle 38 in tight face-to-face engagement when hitch 10 and bucket 54 are attached. Aperatures 68 in the front and rear walls of ear 66 permit a locking pin, designated 44 in FIGS. 3 and 5, to extend through the ear (and through aperatures 42 of receptacle 38) with the axis of the pin parallel with and slightly above to wall 56 and perpendicular to the axis of cross member 60. For structural rigidity, cross member 60 spans the width of bucket 54 and is rigidly secured (e.g., welded) to the bucket side walls 62, 64.

Figure 6:
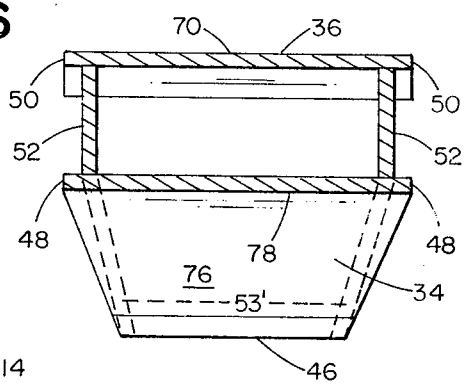
FIG. 6 is a sectional view, taken at 6—6 of FIG. 4, of a portion of the apparatus of FIG. 1–5.
Figure 5:
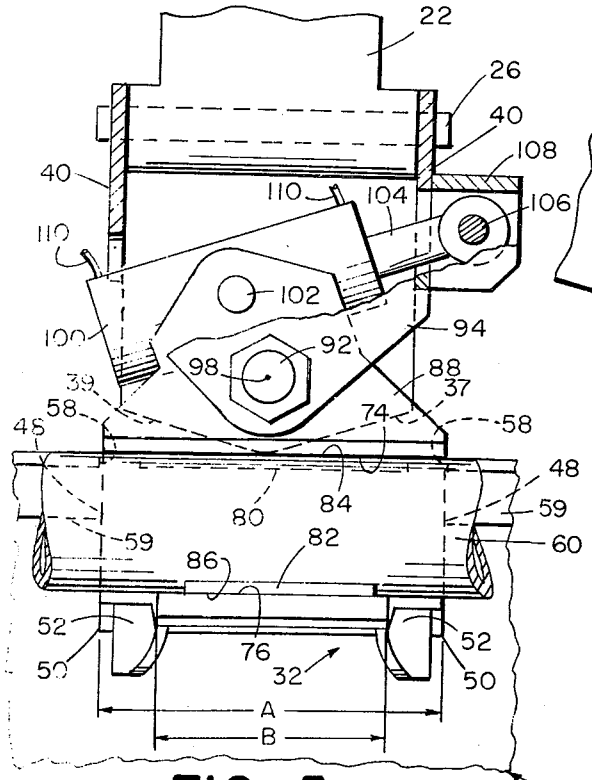
FIG. 5 is a partially broken away front elevation of the apparatus shown in FIG. 4.

Referring to FIGS. 4–6, the jaw of hook 32 is formed by channel 34 which defines an upper engagement surface 74, a lower engagement surface 76, and a rear engagement surface 78. In the illustrated embodiment, in which upper and lower surfaces 74, 76 are parallel to each other and perpendicular to rear surface 78, the vertical (perpendicular) distance between surfaces 74 and 76 is substantially equal (to provide a tight fit) to the outer diameter of cross-member 60; and the depth of the hook jaw (the distance from the front of rear surface 78 to the forward edge of nose 46) is about the same as the cross-member diameter. In other embodiments, the jaw may, for example, be semi-cylindrical or V-shaped, and the jaw will be sized tightly to engage an appropriately shaped, typically cylindrical, cross-member.

The overall width of hook 32 is defined by the sides of channel 34 and rear plate 36 which, as shown, project beyond hook side plates 52 and define side edges 48, 50, respectively. The major portion of hook

32 has a width, designated A in FIG. 5 substantially equal (to provide a tight fit) to the width of opening 58 between bearing plates 59. The nose portion of the hook, that portion forward of rear surface 78 and not above surface 76, tapers to a lesser width, designated B, at the forward end of the nose. The taper is provided by the side edges of the portions of channel 34 defining lower surface 76; and, since the minimum width is less than the normal distance between plates 52, by the converging nose portions 53 thereof.

As best seen in FIG. 4, hook rear plate 36 extends generally vertically downwardly from within hook housing 14 along the back of hook side plates 52 and then curves partially around the bottom of the hook. Most of the hook bottom (i.e., between the lower edge of rear plate 36 and nose 46) is open. The overall depth of hook 32, thus, is the perpendicular distance from nose 46 to the plane of the flat, vertical rear surface portion 70 of plate 36. In the illustrated embodiment, the overall depth is about 8½ inches. The minimum depth (between surfaces 70 and 78) is about 4½ inches.

The length of opening 58 in bucket top wall 56, defined by rear edge 72 of the opening and by the portion of cylindrical member 60 nearest edge 72, is less than the overall depth of hook 32, typically by not less than the radius of cross member 60. In the illustrated embodiment in which radius of the outer surface of cross member 60 is approximately 2¼ inches, the length of opening 58 is about 5⅝ inches. When hook 32 has been fully engaged with cross member 60, the distance between rear edge 72 of opening 58 and the rear 70 of hook 32 is about 1½ inches.

As shown most clearly in FIG. 4, the outer surface of cross member 60 is not entirely cylindrical, but includes a pair of projections 80, 82, each of which defines a flat bearing surface, designated 84, 86, extending the width of the portion of member 60 engaged by hook 32. Upper bearing surface 84 extends tangentially from the top of member 60 toward opening 58, and bearing surface 80 extends tangentially from the bottom of member 60 away from the opening. When hook 32 is attached to bucket 54, bearing surfaces 84, 86 engage, respectively, hook surfaces 74, 76. In the disclosed embodiment, in which hook surfaces 74, 76 are parallel to top wall 56, upper bearing surface 84 is coplanar with upper wall 56 and lower bearing surface 86 is spaced therebelow a distance equal to the distance between hook surfaces 74, 76.

Referring again to FIGS. 4 and 5, hook 32 is pivotal with respect to the main body 40 of hitch 10 about an axis generally perpendicular to axis 16. As shown, a pair of parallel supports 88, 90 project upwardly into hook body 14 from adjacent the front and rear of hook 32. Support 90 is a reinforced extension of rear plate 36. A hinge pin 92, secured between supports 94, 96 welded to the side walls 40 of hitch body 14, passes through openings in supports 88, 90. The axis 98 of hinge pin 92 is coincident with the axis of the openings 42, 68 which receive locking pin 44; and accordingly is elevated above top wall 56 and perpendicular to the axis of cross member 60.

A hydraulic cylinder 100 and piston 104 are secured between hook support plates 88, 90 (by a pivot pin 102 above hinge pin 92) and to a projecting abutment 108 at a side wall 40 of hitch body 14 (by pivot pin 106). As shown, pivot pin 102 is connected to a center portion, rather than an end, of cylinder 100; and the cylinder, piston 102, and abutment 108 are all generally in line with hook 32 and between axis 16 and pin 26. Hydraulic lines 110 provide for flow of fluid into and from cylinder 100. To provide for freedom of rotation, the height of receptacle 38 in hitch body 14 is greater than the height of ear 66 on bucket 54, resulting in free space 112 within the receptacle above the ear, and front surface 67 of ear 66 and inner surface 41 of receptacle 41 are perpendicular to axis 98.

Figure 2:
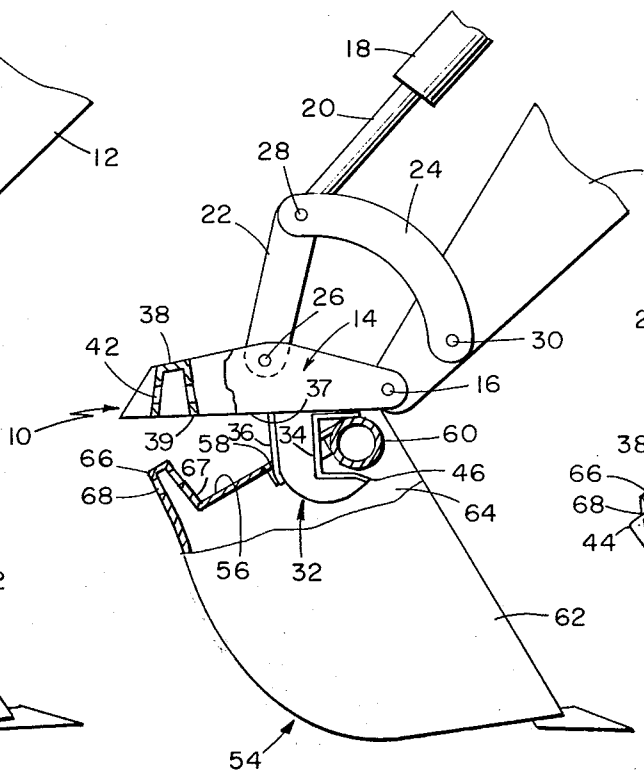
Figure 1:
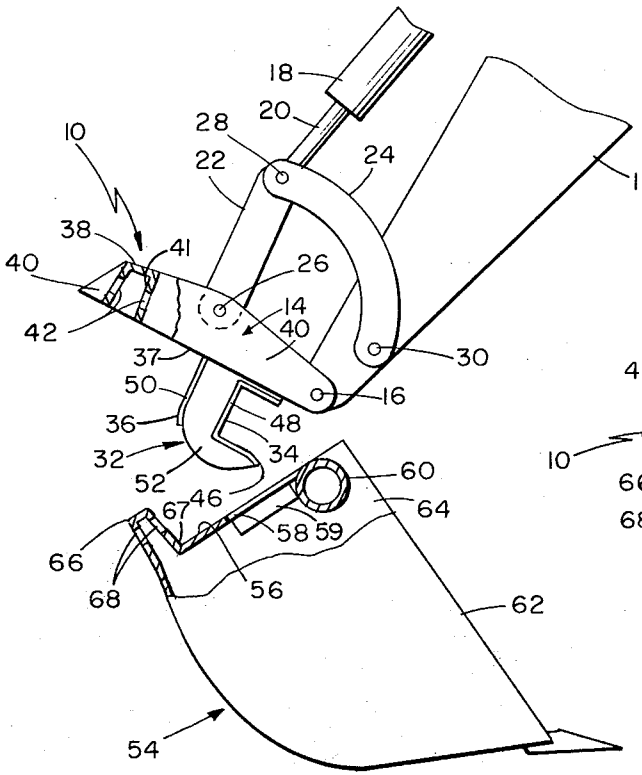

The operation of hitch 10 and its cooperation with the connecting structure of bucket 54 can be best understood from the sequence illustrated in FIGS. 1–3. As shown, in FIG. 1, the hitch is initially positioned above and closely adjacent bucket 54 with hook 32 laterally and longitudinally aligned with opening 58 in bucket upper wall 56. In this position, the axis of apertures 42 makes an acute angle with the axis of openings 68 in ear 66. Bucket cylinder piston 20 is then extended, causing hitch 14 to rotate about axis 16 and inserting hook 32 into opening 58. As the hitch is rotated, upwardly-facing hook engagement surface 76 engages and slides under cross member 60. Simultaneously, the angle between the axes of aperatures 42 and openings 68 diminishes, all as seen in FIG. 2. Continued rotation of hitch 14 about axis 16 results in the hook jaw sliding forward around cross member 60, and ear 66 passing into receptacle 38. The lower front edge 39 of receptacle 38 engages the forward surface 67 of ear 66, and the interaction between the edge and surface provides a camming action which forces hook jaw surface 78 into engagement with the rear of cross member 60. Ear 66 then slides completely into receptacle 38, with the ear front surface 67 in tight face-to-face engagement with receptacle inner front surface 41, providing precise fore and aft alignment of the hitch and bucket. The lower point of the tongue of receptacle front wall edge 39 engages the top wall 56 of bucket to provide a "stop" for precise relative vertical alignment of the hitch and bucket, with holes 42 of receptacle 38 aligned with holes 68 of ear 66. Locking pin 44 may then by manually inserted into place, from the rear of the bucket, and rotated 90° to lock it in position.

The upper body portion of hook 32 and bucket opening 58 are substantially the same width to prevent relative twisting when the hitch and bucket are attached. The tapered nose makes for easy insertion of the hook into opening 58 despite minor misalignment or inexpert maneuvering of the dipperstick by providing a sort of guiding or funnelling effect during the connecting operation, especially the initial portions thereof depicted in FIGS. 1–2.

The length of opening 58 relative to the overall and minimum depths of hook 32 make it virtually impossible for the hook accidentally to disengage from bucket 54 during an attempted link-up. The depth of opening 58 between its rear edge 72 and cross member 60 is such that if the hook in the partially attached configuration shown in FIG. 2 should begin to slip off cross member 60, it would simply become wedged in opening 58. The back of the hook would bear against the rear edge 72 of opening 58 while the upwardly-facing hook engagement surface 76 would continue to bear against the bottom of cross member 60. Further rotation of hitch 10 would continue to draw the hook around cross member 60 into more positive engagement therewith, as shown in FIG. 3.

As shown in FIG. 4, hook 32 can, in addition to swinging about axis 16, pivot about the axis 98 which is perpendicular to the axis 16. With piston rod 104 secured to the sidewalls of hitch body 14 and the cylinder 100 secured to hook plates 88, 90, relative motion between cylinder 100 and piston 104 will cause rotation of hook 32 about axis 98. This extra degree of freedom not only permits greater flexibility and utility of bucket 54 in handling materials after secured to hitch 10, but cooperates with the "funnelling" effect discussed above to achieve the easy and rapid engagement of hitch 10 with bucket even if the bucket is resting on a tilted or inclined surface prior to its engagement with the hitch. Locking pin 44 serves as a second support point along axis 98 for the swinging movement of bucket 54 about axis 98 as hook 32 moves. The free space 112 in receptacle 38 and the tongue shape of bottom edge 39 assure that there will be no interference of such swinging motion of the bucket 54. Also bottom edges 37 of side plates 40 must be elevated above bucket wall 56 to avoid interference with swinging of the bucket.

Referring now to FIGS. 7–8, there is shown a slightly modified hitch 10' attached to a bucket 54'. Hitch 10' and the cooperating portions of bucket 54' are substantially similar to hitch 10 and the cooperating portions of bucket 54 described hereinbefore, and similar parts are identified by the same reference numerals as used previously, with a differentiating prime (') added.

Hitch 10' comprises two generally vertical side plates 40', each of which includes a downwardly depending portion 52' which defines one side of hook 32'. Receptacle 38', a base plate 120 which closes the bottom of hitch body 14' between the rear of hook 32' and the front of receptacle 38', and channel member 34' are welded between side plates 40'. As shown, channel 34' includes, in addition to the portions thereof defining the jaw of hook 32', a reinforcing portion 122 projecting upwardly into hitch body 14 between side plates 40'.

In lieu of the manually operated locking pin 44 of the previously described embodiment, hitch 10' includes a hydraulic cylinder 124 and piston 126 mounted in hitch body 14'. Cylinder 124 is positioned between a pair of locking stops 125, with its forward end adjacent reinforcing portion 122 of channel 34'. In its retracted position, (shown in dashed lines in FIG. 7), piston 126 extends partially into the aperture 42' in the forward wall of receptacle 38'. When the piston is extended, by flow of fluid in cylinder hydraulic lines 128, it extends completely through receptacle 38'. For self-alignment of piston 126 with aperture 42', stops 125 permit cylinder 124 to float both horizontally and vertically.

As shown most clearly in FIG. 8, hitch 10' does not include a plate on the rear of hook 32', and the sides of channel 34' do not project outwardly beyond sides 52'. Thus, the width of hook 32' is defined by sides 52', which as before converge toward nose 46' to provide the desired funnelling effect during engagement of the hook and cooperating structure on bucket 54'; and the overall and minimum depth are defined, in part, by the rear edges 53 of sides 52'.

The cooperating structure on bucket 54' includes an opening 58' in the top wall 56' of the bucket, a generally cylindrical cross member 60' with respective upper and lower flat bearing surfaces 84' and 86' and welded between the supporting side walls 62', 64' of the bucket, and ear 66' projecting upwardly above the top wall 56' at a point spaced to the rear of the rear edge 72' of opening 58'. As in the cooperating structure of bucket 54, flat bearing surface 84' is substantially coplanar with top wall 56' and cross member 60' defines the front of opening 58'.

Bearing plates 59' are mounted on the inside of side walls 62', 64' each defining one side of opening 58' and extending vertically downwardly from the plane of top wall 56' a distance equal to about one-half the height of hook 32'. When hitch 10' and bucket 54' are attached, each of bearing plates 59' engages the adjacent side 52' of hook 32' and prevents twisting of hook 32' in opening 58' relative to bucket 54.'

The construction of ear 66' is slightly different from that of ear 66 of bucket 54. As shown, ear 66' includes a solid generally semi-cylinder 130 mounted above top wall 56' with its base parallel to the axis of cylindrical cross member 60' and receptacle inner wall 41'; and a reinforcing plate 132 extending from the rear of semi-cylinder 130 to the rear of bucket 54', and welded to both. A cylindrical opening 68' extends coaxially through semi-cylinder 130 to tightly receive piston 126 when ear 66' is fitted within receptacle 38' and piston 126 is extended.

Since hook 32' is not designed to pivot with respect to hitch body 14', relative vertical alignment is provided by having the top of ear 66' engage the inner top surface of the receptacle when the hitch and bucket are engaged; alternatively, the top wall 56' of the bucket may engage base plate 120 of the hitch. As with the previously described embodiment, fore-and-aft alignment of the hitch and bucket is determined by the respective engagement of the forward surface of ear 66' with the adjacent inner wall of receptacle 38', and of jaw surface 78' with cross member 60'.

Figure 10:
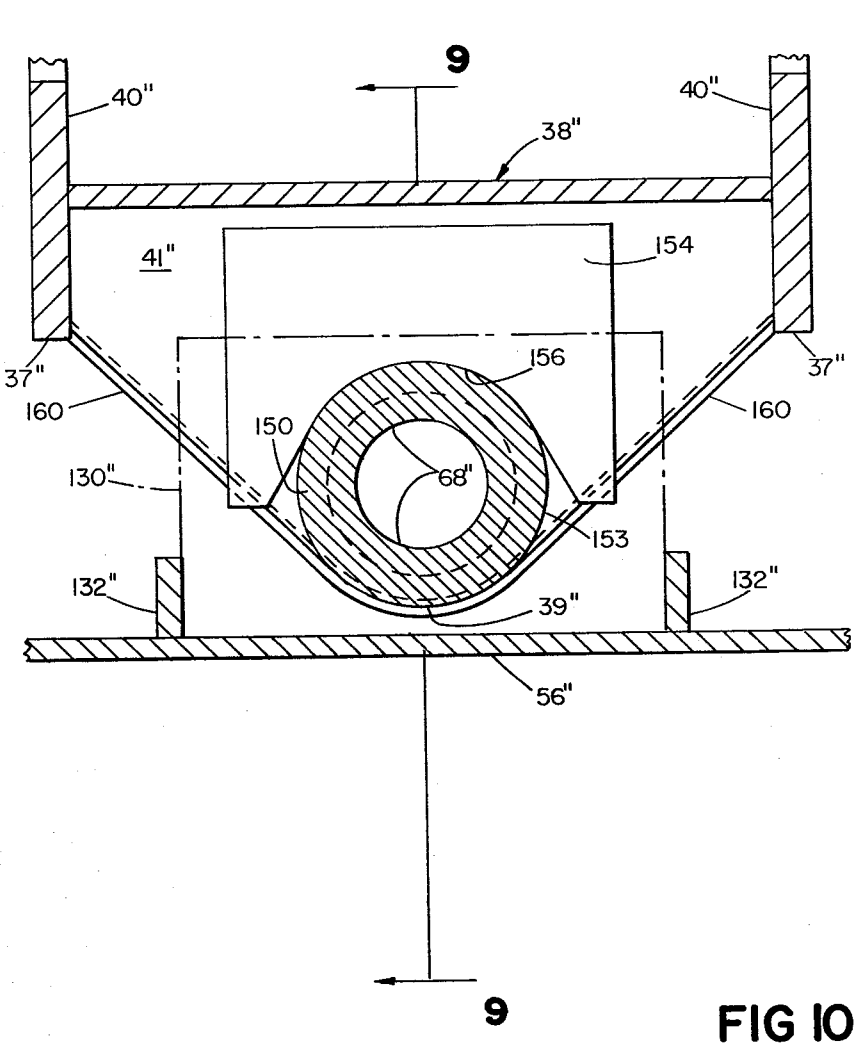
FIGS. 9 and 10 are plan views, partially in section, of a further modified embodiment of the present invention.
Figure 9:
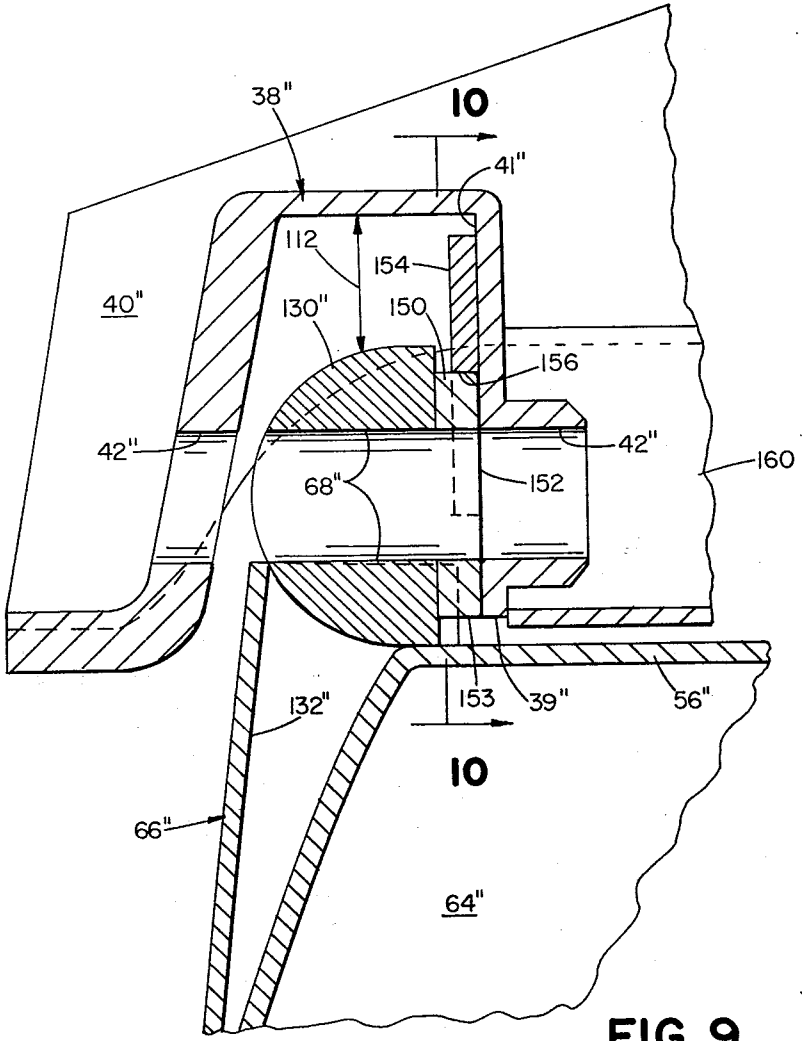

Reference is now made to FIGS. 9 and 10 which illustrate a modified ear 66'' and receptacle 38''. Portions of the device illustrated are substantially the same as corresponding portions of embodiments previously described and are identified by the same reference numerals as used previously, with a differentiating double prime ('') added thereto. As will become apparent, the modification of FIGS. 9 and 10 is especially useful with systems of the type described in FIGS. 1–6, in which the hook and hitch body can be rotated relative to each other. It also presents advantages in systems in which the hook and hitch body are relatively fixed.

As shown, ear 66'' differs from ear 66' in that a cylindrical boss 150 is welded to the center of the flat base of semicylinder 130''. The axis of boss 150 is coaxial with the axis of ear opening 68'', and its vertical end surface 152 is perpendicular to the axis of opening 68'' and arranged to engage inner wall 41'' of receptacle 38'' face-to-face when the hitch and tool are engaged.

A guide plate 154 defining an upwardly concave, annular guide surface 156 is welded on the inside of wall 41''. The radius of guide surface 156 is equal to that of the cylindrical peripheral surface 153 of boss 150, and the guide surface is coaxial with openings 42''. When guide surface 156 and cylindrical peripheral surface 153 engage each other, openings 68'' and 42'' will be accurately coaxially aligned.

To permit relative rotation of the hitch and tool (and of receptacle 38'' and ear 66''), the engaged surface 152 of boss 150 and 41'' of receptacle 38'' are perpendicular to each other, free space 112'' is provided above semi-cylinder 130'', and lower edges 37'' of hitch sides 40'' are spaced above the upper wall 56'' of the tool. Forward of receptacle 38'', bottom closure plate 160 extends between hitch sides 40''. As shown in FIG. 10, closure plate 160 is in the form of a wide "V", with its lower edge rounded and spaced above tool upper wall 56'' and its upper edges secured to hitch sides 40''.

In operation, the engaged surfaces 153, 156 of boss 150 and guide plate 154 provide for relative alignment of ear 66'' and receptacle 38'' in both the vertical and transverse directions. Because it is not required to provide a vertical stop, as it did in the embodiment of FIGS. 1–5, the rounded lower front edge 39'' of receptacle 38'' is spaced above upper wall 56''. When the modification of FIGS. 9–10 is used in a system in which the hook and hitch are rotated about the axis of the connecting pin (and of openings 68'', 42''), engaged surfaces 153, 156 act as bearings and relieve much of the load otherwise placed on the connecting pin.

While particular preferred embodiments have been illustrated in the accompanying drawings and described in detail herein, other embodiments are within the scope of the invention and following claims.

I claim:

1. Apparatus for releasably securing a materials handler to a boom while permitting rotation of said materials handler about a first axis fixed with respect to said boom, said apparatus comprising:

a hitch adapted for pivotal connection to said boom for rotation about said first axis and including a hitch body, a hook member of predetermined maximum width projecting outwardly from said body, and a hitch locking member spaced from said hook member in a direction generally perpendicular to said first axis, said hook member defining a jaw having a jaw engagement surface, a tapering nose portion of width less than said predetermined maximum width facing away from said hitch locking member in a direction generally perpendicular to said first axis, and a rear surface intermediate said nose portion and said hitch locking member and facing generally towards said hitch locking member; and, cooperating structure secured to said materials handler for receiving and engaging said hook member and for engaging said hitch locking member, said cooperating structure defining an opening of width substantially equal to said maximum width of said hook member for receiving said hook member, a cooperating structure locking member spaced from said opening on one side thereof for engaging said hitch locking member, and a rigid crossmember extending transversely the width of said opening adjacent the side thereof opposite said cooperating structure locking member for engaging said jaw engagement surface when said hook member is inserted within said opening, the overall depth of said hook member being defined by said rear surface and the end of said nose portion most distant therefrom, the length of said opening being defined by one surface intermediate said rigid cross-member and said cooperating structure locking member and facing generally towards said cross-member, and a second and generally oppositely facing surface on the side of said one surface opposite said cooperating structure locking member, said length of said opening being less than the distance from said jaw engagement surface to said hitch locking member.

2. The apparatus of claim 1 wherein said jaw defines a pair of said engagement surfaces, and said cross-member includes a pair of flat bearing surfaces extending generally axially thereof and projecting in generally opposite directions from spaced portions thereof, one of said flat surfaces projecting toward the rear of said opening from the upper half of said cross-member and being adapted for engaging the upper one of said hook engagement surfaces, and the other of said flat surfaces projecting from the lower half of said cross-member and being adapted to engage the other of said hook engagement surfaces.

3. The apparatus of claim 2 wherein said cross-member is substantially cylindrical and said pair of flat bearing surfaces project generally tangentially thereof.

4. The apparatus of claim 2 wherein the front and rear of said hook member above said upper one engagement surface are of said overall width.

5. The apparatus of claim 4 wherein the bottom of said hook member is open.

6. The apparatus of claim 1 wherein said opening is in a wall of said cooperating structure and the top of said cross-member is in the plane of said wall.

7. The apparatus of claim 1 wherein said hook jaw includes generally parallel upper and lower engagement surfaces and a rear engagement surface extending between said upper and lower engagement surfaces and defining said minimum depth, said cross member is substantially cylindrical, and the diameter of said cross member is substantially equal to the distance between said upper and lower engagement surfaces.

8. The apparatus of claim 7 wherein said rear engagement surface is generally perpendicular to said upper and lower engagement surfaces and parallel to said first axis.

9. The apparatus of claim 8 wherein said opening is in a top wall of said cooperating structure, and the top of said cross-member is tangential to the plane of said wall.

10. The apparatus of claim 7 wherein said cross member includes a pair of axially-extending flat bearing surfaces projecting generally tangentially and in opposite directions from opposite sides of said cross member, one of said flat surfaces being adapted for engaging said upper hook engagement surface and projecting toward the rear of said opening, and the other of said flat surfaces being adapted for engaging said lower hook engagement surface.

11. The apparatus of claim 10 wherein said opening is in a top wall of said cooperating structure, and said one flat surface is substantially coplanar with said wall.

12. The apparatus of claim 10 wherein each of said bearing surfaces is parallel to said wall, the one of said bearing surfaces nearer said wall extending tangentially of said cross member towards said rear edge of said opening.

13. The apparatus of claim 1 wherein said overall depth is greater than the distance from said one surface of said opening to the nearest portion of said cross-member.

14. The apparatus of claim 13 wherein said overall depth is not less than the sum of said distance from said one edge and one-half the front-to-back thickness of said cross member.

15. The apparatus of claim 14 wherein the difference between said overall depth and said minimum depth is not less than about said front-to-back thickness.

16. The apparatus of claim 1 wherein each of said locking members includes aperatures extending therethrough in a direction perpendicular to said first axis, said hitch and said cooperating structure include stops for coaxially aligning said apertures with each other when said locking members are engaged with each other, and including a locking pin extending through said apertures and securing said locking members together.

17. The apparatus of claim 1 wherein said cooperating structure includes a pair of spaced bearing members defining the width of said opening, each of said bearing members having a height equal to not less than about one-half the height of said hook member above said rear engagement surface thereof.

18. The apparatus of claim 1 wherein said hitch includes a downwardly-facing surface spaced from said hook member and arranged to engage an upwardly-facing portion of said handler spaced from said cross-member when said hitch and said handler are engaged and thereby vertically locate said locking members relative to each other.

19. The apparatus of claim 18 wherein said downwardly-facing surface is defined by the body of said hitch, and said opening and said upwardly-facing portion are defined by a top wall of said handler.

20. The apparatus of claim 18 wherein said downwardly-facing surface is defined by said locking member of said hitch.

21. The apparatus of claim 1 wherein said hook projects downwardly from the body of said hitch, said hitch locking member is above said jaw engagement surface, said opening is defined by a wall of said cooperating structure, and said locking member of said cooperating structure projects above said wall.

22. The apparatus of claim 1 wherein the distance between said hitch locking member and a point on said hook jaw adapted to engage said cross-member is substantially equal to the distance between said materials handler locking member and the portion of said cross-member arranged to be engaged by said point.

23. Apparatus for releasably securing a materials handler to a boom while permitting rotation of said materials handler about a first axis fixed with respect to said boom, said apparatus comprising:

a hitch adapted for pivotal connection to said boom for rotation about said first axis and including a hitch body, a hook member of predetermined maximum width projecting outwardly from said body, and a hitch locking member spaced from said hook member in a direction generally perpendicular to said first axis, said hook member defining a jaw having a jaw engagement surface, a tapering nose portion of width less than said predetermined maximum width facing away from said hitch locking member in a direction generally perpendicular to said first axis, and a rear surface intermediate said nose portion and said hitch locking member and facing generally towards said hitch locking member; and, cooperating structure secured to said materials handler for receiving and engaging said hook member and for engaging said hitch locking member, said cooperating structure defining an opening of width substantially equal to said maximum width of said hook member for receiving said hook member, a cooperating structure locking member spaced from said opening on one side thereof for engaging said hitch locking member, and a rigid cross-member extending transversely the width of said opening adjacent the side thereof opposite said cooperating structure locking member for engaging said jaw engagement surface when said hook member is inserted within said opening, the overall depth of said hook member being defined by said rear surface and the end of said nose portion most distant therefrom, the length of said opening being defined by one surface intermediate said rigid cross-member and said cooperating structure locking member and facing generally towards said cross-member, and a second and generally oppositely-facing surface on the side of said one surface opposite said cooperating structure locking member, said length of said opening being less than the distance from said jaw engagement surface to said hitch locking member, said body of said hitch and said hook member of said hitch being connected for pivotal movement relative to each other about a second axis generally perpendicular to said first axis, and said apparatus including an actuator connected thereto and operable for pivoting said hook member relative to said body.

24. The apparatus of claim 23 wherein said actuator is substantially in line with said hook member and intermediate the axes of connection of said hitch to said boom.

25. The apparatus of claim 24 wherein said actuator includes a piston and cylinder, said piston being pivotally connected to said body of said hitch, and said cylinder being pivotally connected intermediate its ends to said hook of said hitch.

26. The apparatus of claim 23 including a pivot pin coaxial with said second axis and pivotally connecting said hitch body and said hook member together, said second axis being spaced from said hook jaw on the side thereof towards said hitch body.

27. The apparatus of claim 26 including a second pin coaxial with said second axis and adapted for removably connecting said hitch body and said handler together whereby said hitch body and said handler are pivotable relative to each other about said pivot pin and said second pin.

28. The apparatus of claim 27 wherein said actuator is pivotally connected to said body and to a portion of said hook member on the side of said pivot pin opposite said jaw.

29. The apparatus of claim 27 wherein each of said locking members include apertures extending therethrough, each of said apertures is coaxial with said second axis, and said second pin is a locking pin extending removably through said apertures and securing said locking members together.

30. The apparatus of claim 29 wherein said hitch locking member defines a downwardly-facing surface, said locking member of said cooperating structure defines an upwardly-facing surface arranged to engage said downwardly-facing surface when said hitch and said handler are engaged, and each of said surfaces is generally semi-cylindrical and coaxial with said apertures and said second axis whereby said edges vertically and transversely relatively located said locking members and provide bearing surfaces for said pivoting of said handler relative to said hitch body.

31. Apparatus for releasably securing a materials handler to a boom while permitting rotation of said materials handler about a first axis fixed with respect to said boom, said apparatus comprising:

a hitch adapted for pivotal connection to said boom for rotation about said first axis and including a hitch body, a hook member of predetermined maximum width projecting downwardly from said body, and a hitch locking member spaced from said hook member in a direction generally perpendicular to said first axis, said hook member defining a jaw having a jaw engagement surface, a tapering nose portion of width less than said predetermined maximum width facing away from said hitch locking member in a direction generally perpendicular to said first axis, and a rear surface intermediate said nose portion and said hitch locking member and facing generally towards said hitch locking member; and, cooperating structure secured to said materials handler for receiving and engaging said hook member and for engaging said hitch locking member, said cooperating structure defining an opening of width substantially equal to said maximum width of said hook member for receiving said hook member, a cooperating structure locking member spaced from said opening on one side thereof for engaging said hitch locking member, and a rigid cross-member extending transversely the width of said opening adjacent the side thereof opposite said cooperating structure locking member for engaging said jaw engagement surface when said hook member is inserted within said opening, the overall depth of said hook member being defined by said rear surface and the end of said nose portion most distant therefrom, the length of said opening being defined by one surface intermediate said rigid cross-member and said cooperating structure locking member and facing generally towards said cross-member, and a second and generally oppositely-facing surface on the side of said one surface opposite said cooperating structure locking member, said length of said opening being less than the distance from said jaw engagement surface to said hitch locking member, said hitch including a downwardly-facing surface defined by said locking member of said hitch and arranged to engage an upwardly-facing portion of said handler spaced from said cross member, and said downwardly-facing surface and said upwardly-facing portion being generally semi-cylindrical whereby said downwardly-facing surface and said portion vertically and transversely locate said locking members relative to each other when said hitch and said handler are engaged.

32. The apparatus of claim 31 wherein each of said locking members include apertures extending therethrough in a direction perpendicular to said first axis, a locking pin extends through said apertures and secures said locking members together, and said semi-cylindrical edge is coaxial with said apertures of said hitch locking member and said semi-cylindrical portion is coaxial with said apertures of said handler locking member.

33. The apparatus of claim 32 wherein said body of said hitch and said hook member of said hitch are connected for pivotal movement about the axis of said apertures of said hitch locking member, said axis being perpendicular to said first axis; and including an actuator connected to said body and said hook member for causing said pivoting.

34. Apparatus for releasably securing a materials handler to a boom while permitting rotation of said materials handler about a first axis fixed with respect to said boom, said apparatus comprising:

a hitch adapted for pivotal connection to said boom for rotation about said first axis and including a hitch body, a hook member of predetermined maximum width projecting outwardly from said body, and a hitch locking member spaced from said hook member in a direction generally perpendicular to said first axis, said hook member defining a jaw having a jaw engagement surface, a tapering nose portion of width less than said predetermined maximum width facing away from said hitch locking member in a direction generally perpendicular to said first axis, and a rear surface intermediate said nose portion and said hitch locking member and facing generally towards said hitch locking member;

cooperating structure secured to said materials handler for receiving and engaging said hook member and for engaging said hitch locking member, said cooperating structure defining an opening of width substantially equal to said maximum width of said hook member for receiving said hook member, a cooperating locking member spaced from said opening on one side thereof for engaging said hitch locking member, and a rigid cross-member extending transversely the width of said opening adjacent the side thereof opposite said cooperating structure locking member for engaging said jaw engagement surface when said hook member is inserted within said opening, the overall depth of said hook member being defined by said rear surface and the end of said nose portion most distant therefrom, the length of said opening being defined by one surface intermediate said rigid cross-member and said cooperating structure locking member and facing generally towards said cross-member, and a second and generally oppositely-facing surface on the side of said one surface opposite said cooperating structure locking member, said length of said opening being less than the distance from said jaw engagement surface to said hitch locking member, each of said locking members including an aperture extending therethrough in a direction perpendicular to said first axis:

said hitch and said cooperating structure including stops for coaxially aligning said aperatures with each other when said locking members are engaged with each other;

a locking pin extending through said aperatures and securing said locking members together; and, a hydraulic piston and cylinder for actuating said locking pin mounted on said hitch, said pin being attached to said piston, and said cylinder being restrained against movement in a direction parallel to the axis of said aperatures but being free to float in the plane perpendicular to said axis of said apertures whereby said pin is self-aligning.

35. The apparatus of claim 34 wherein said piston and cylinder are operable to move said pin between a first position wherein said pin extends through said apertures and secures said locking members together and a second position wherein an end of said pin is positioned within the aperture of said hitch locking member nearest said cylinder and said locking members are free to move relative to each other.

36. Apparatus for releasably securing a materials handler to a boom while permitting rotation of said materials handler about a first axis fixed with respect to said boom, said apparatus comprising:

a hitch adapted for pivotal connection to said boom for rotation about said first axis and including a hitch body, a hook member of predetermined maximum width projecting outwardly from said body, and a hitch locking member spaced from said hook member in a direction generally perpendicular to said first axis, said hook member defining a jaw having a jaw engagement surface, a tapering nose portion of width less than said predetermined maximum width facing away from said hitch locking member in a direction generally perpendicular to said first axis, and a rear surface intermediate said nose portion and said hitch locking member and facing generally towards said hitch locking member; and, cooperating structure secured to said materials handler for receiving and engaging said hook member and for engaging said hitch locking member, said cooperating structure defining an opening of width substantially equal to said maximum width of said hook member for receiving said hook member, a cooperating structure locking member spaced from said opening on one side thereof for engaging said hitch locking member, and a rigid cross-member extending transversely the width of said opening adjacent the side thereof opposite said cooperating structure locking member for engaging said jaw engagement surface when said hook member is inserted within said opening, the overall depth of said hook member being defined by said rear surface and the end of said nose portion most distant therefrom, the length of said opening being defined by one surface intermediate said rigid cross-member and said cooperating structure locking member and facing generally towards said cross-member, and a second and generally oppositely-facing surface on the side of said one surface opposite said cooperating structure locking member, said length of said opening being less than the distance from said jaw engagement surface to said hitch locking member, and each of said locking members including a camming surface arranged for engaging the camming surface of the other of said locking members and urging said engagement surface of said hook jaw into engagement with said cross member when said locking members are moved into engagement with each other.

* * * * *

UNITED STATES PATENT AND TRADEMARK OFFICE

CERTIFICATE OF CORRECTION

PATENT NO. : 3,934,738
DATED : January 27, 1976
INVENTOR(S) : Carroll H. Arnold

It is certified that error appears in the above-identified patent and that said Letters Patent are hereby corrected as shown below:

Column 6, line 57, "funnelling effect" should be quoted;

Column 7, line 48, "semicylinder" should be hyphenated;

Column 13, line 30, after "cooperating", insert --structure--.

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*